US005179851A

United States Patent [19]

Turley et al.

[11] Patent Number: 5,179,851

[45] Date of Patent: Jan. 19, 1993

[54] CROWN ADJUSTMENT CONTROL SYSTEM FOR CLUSTER MILLS

[75] Inventors: John W. Turley, Oxford; Michael G. Sendzimir, Woodbury, both of Conn.

[73] Assignee: T. Sendzimir, Inc., Westbury, Conn.

[21] Appl. No.: 628,221

[22] Filed: Dec. 14, 1990

[51] Int. Cl.[5] ..... B21B 37/08; B21B 31/22; B21B 31/34

[52] U.S. Cl. ..... 72/7; 72/21; 72/35; 72/241.4; 72/242.4

[58] Field of Search ..... 72/6-11, 72/21, 31-35, 240, 241.2, 241.4, 242.2, 242.4, 248; 364/472, 148, 160

[56] References Cited

U.S. PATENT DOCUMENTS

| | | | |
|---|---|---|---|
| Re. 28,248 | 11/1974 | Herbst . | |
| 2,169,711 | 8/1939 | Sendzimir . | |
| 2,187,250 | 1/1940 | Sendzimir . | |
| 2,194,212 | 3/1940 | Sendzimir . | |
| 2,776,586 | 1/1957 | Sendzimir . | |
| 2,982,901 | 5/1961 | Cannon | 72/240 |
| 3,147,648 | 9/1964 | Sendzimir . | |
| 3,287,946 | 11/1966 | Perrault et al. | 72/248 |
| 3,478,559 | 11/1969 | Polakowski . | |
| 3,644,897 | 2/1972 | McCrea et al. | 364/148 |
| 3,976,981 | 8/1976 | Bowden | 364/160 |
| 4,022,040 | 5/1977 | Turley . | |
| 4,037,087 | 7/1977 | Foulds | 364/472 |
| 4,125,004 | 11/1978 | Alshuk | 72/9 |
| 4,156,359 | 5/1979 | Verbickas . | |
| 4,269,051 | 5/1981 | Clarke et al. | 72/9 |
| 4,289,013 | 9/1981 | Hunke . | |
| 4,839,818 | 6/1989 | Phillips | 364/148 |
| 5,010,756 | 4/1991 | Nose et al. | 72/9 |

FOREIGN PATENT DOCUMENTS

| | | | |
|---|---|---|---|
| 0116915 | 7/1983 | Japan | 72/242.4 |
| 0255710 | 11/1986 | Japan | 72/242.4 |
| 0176607 | 8/1987 | Japan | 72/241.4 |
| 0016804 | 1/1988 | Japan | 72/241.4 |
| 2021809 | 12/1979 | United Kingdom | 72/6 |

*Primary Examiner*—John Sipos
*Assistant Examiner*—Thomas C. Schoeffler
*Attorney, Agent, or Firm*—Frost & Jacobs

[57] ABSTRACT

There is provided a mill computer control system for automatically controlling the position of the individual drives in accordance with at least one predetermined equation so as to produce variable profile forms of the roll gap. Crown forms and tapered forms are generated by the computer in response to single keystroke commands on the keyboard. The drives may be adjusted simultaneously or individually. Individual adjustments may be made which are preserved during changes in the crown form or the tapered form.

5 Claims, 7 Drawing Sheets

CROWN ADJUSTMENT CONTROL SYSTEM FOR CLUSTER MILLS

TECHNICAL FIELD

The present invention relates to cold rolling cluster strip mills of the general type shown in U.S. Pat. Nos. 2,169,711; 2,187,250; 2,194,212; 2,776,586; 3,147,648 and 4,156,359, and is particularly directed to a method and apparatus for controlling the crown of the mill in response to a single key stroke action taken by the operator. The invention will be specifically disclosed in connection with a mill computer control system which is adapted to position the backing shaft at each respective support saddles accurately in response to keyboard command. The amount of the crown and tilt of the roll is determined by the mill counter control system in response to simple key stroke commands, with the adjustments being effected through the position control loop.

BACKGROUND OF THE INVENTION

The function of the crown adjustment on a cold rolling strip mill is to shape the profile of the roll gap to the profile of the strip entering the mill, in order to produce uniform elongation, and hence good flatness of the strip being processed.

The crown adjustment mechanism on all Sendzimir large cluster mills since 1957 has been effected via an eccentric ring mounted in each respective support saddle in the uppermost two backing shafts. The eccentric ring has two gear pinions mounted to it, one on each side, and attached to the ring by rivets. A rack engages with the gear pinions and causes rotation of the eccentric ring as it is traversed. An independent drive is supplied for each rack, so that the position of the backing shaft can be adjusted at each saddle location. A typical construction of the adjustment mechanism of rack, pinions and eccentric rings is shown in FIG. 9 of U.S. Pat. No. 3,147,648. It is also shown in FIGS. 3–6 of U.S. Pat. No. 4,289,013.

The method of driving the adjustment mechanism at each saddle is a matter of design choice In most cases it has been done by a screw jack driven by a hydraulic motor (type 1); in some cases by a screw jack driven by an electric motor (type 2); and in some cases by a hydraulic cylinder (type 3). U.S. Pat. No. 3,478,559 disclosed the use of hydraulic cylinders for crown adjustment in 1969.

During the years since 1957 various methods of indicating the position of the adjustment mechanisms have been used. The earliest systems used simple mechanical pointers directly mounted on the drive mechanism on top of the mill, which were difficult to read. Subsequently, beginning in the 1960's, selsyn indicators with circular dials were used, but did not give the operator a graphic "picture" of the profile set by the various drives Starting in the late 1960's efforts were made to give the operator a better "picture" by arranging the indicators vertically side by side so that relative positions of the adjustment mechanisms, and hence the shape of the mill profile could be seen at a glance. The earliest systems of this kind, mostly installed in Japan, used a system of pulleys and cables so that the movement of a particular crown adjustment rack was directly coupled to the corresponding pointer on the scale, producing proportional concomitant movements of the pointer.

Beginning in the early 1970's, position transducers, such as potentiometers or differential transformers (LVDT's or RVDT's), were used to sense rack position, and were electrically connected to edge type moving coil meters mounted vertically side by side in the operator's desk, as remote readouts of rack position. By the mid 1970's, linear bar graph indicators, consisting of rows of light emitting diode elements, such as those made by Dixson, Inc., of Grand Junction, Colo., became available, and were used in place of the moving coil meters. Such position indication systems are quite common today.

U.S. Pat. No. 4,022,040, which is incorporated herein by reference, teaches how to couple all the crown adjustment drives (type 1 or type 2) together mechanically, using a system of gears and differentials, to achieve the ability to operate all drives together in a synchronized mode, while retaining the ability to operate them individually. The relationship between motions of the various drives is determined by the gear ratios, and can be either set to give "taper" (also known as "tilt") adjustment, or to give "crown" adjustment in response to a single pushbutton command by the operator (but not both).

U.S. Pat. No. 4,156,359 teaches how "tilt" and "crown" adjustment of the drives in response to a single push button command could both be achieved, but without the ability to operate the drives individually. The crown adjustment is controlled by the rotation of a shaft having eccentric cams, carried by a frame pivotably mounted above the roll. Tilting of the frame produces a concurrent tilt of the crown shape.

Thus, there is a need in the art for a mill control system which allows both the crown and tilt to be adjusted, while retaining the ability to adjust the saddles individually. Individual saddle adjustment which allows the position at each saddle to be varied in order to accommodate tolerances or other deviations is also needed. Such a mill control system should preferably be responsive to single key stroke or push button commands in order to allow easy operation.

SUMMARY OF THE INVENTION

Accordingly, it is a primary object of the present invention to provide a mill control system which is operable in both the tilt mode a and the crown mode, while allowing each respective saddle to be individually adjusted.

It is another object of the present invention to provide a mill control system which allows each saddle to be individually adjusted in order to accommodate the needs of the rolling operation.

It is yet another object of the present invention to provide a mill control system which retains the individual adjustments at any particular saddle location while allowing the crown and tilt to be varied.

Yet another object of the present invention is to provide a mill control system which operates in response to a minimum number of key stroke commands, preferably a single key stroke command for each function being adjusted.

A still further object of the present invention is to provide a mill control system which allows contemplated adjustments to the profile of the rolls to be made without actually immediately changing the profile of the roll.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

In accordance with one aspect of the present invention, there is provided a mill computer control system for automatically controlling the position of the individual drives in accordance with at least one predetermined equation so as to produce variable profile forms of the roll gap. Crown forms and tapered forms are generated by the computer in response to single keystroke commands on the keyboard. The drives may be adjusted simultaneously or individually. Individual adjustments may be made which are preserved during changes in the crown form or the tapered form.

Still other objects of the present invention will become apparent to those skilled in this art from the following description wherein there is shown and described a preferred embodiment of this invention, simply by way of illustration, of one of the best modes contemplated for carrying out the invention. As will be realized, the invention is capable of other different embodiments, and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification illustrate several aspects of the present invention, and together with the description serve to explain the principles of the invention. In the drawings.

Reference will now be made in detail to the present preferred embodiment of the invention, an example of which is illustrated in the accompanying drawings.

DETAILED DESCRIPTION OF A PREFERRED EMBODIMENT

Figure 1:
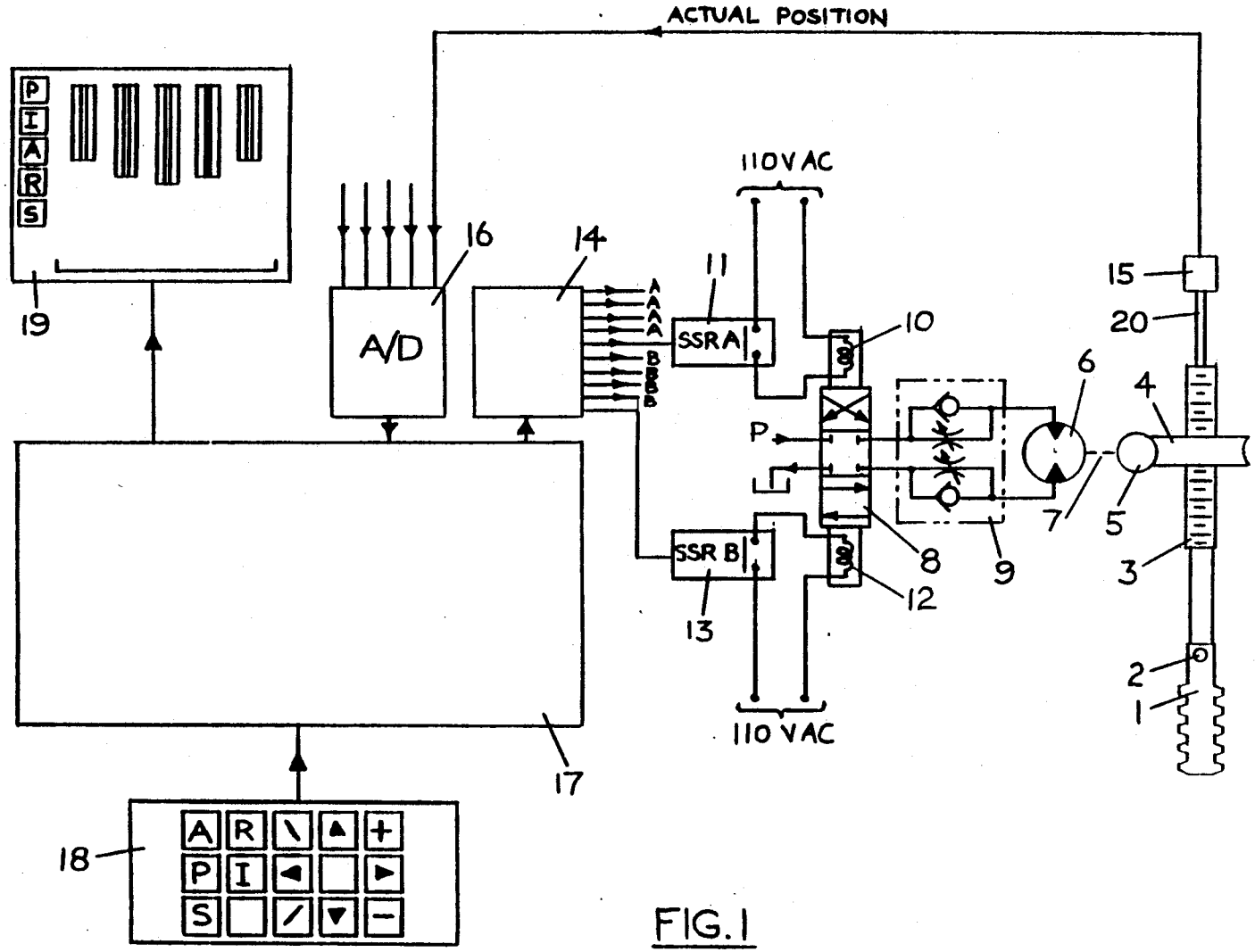
FIG. 1 is a schematic diagram showing a mill computer control system in accordance with the present invention, for operating and controlling a type 1 drive at one saddle location with an on-off position control loop.

In FIG. 1, a mill computer control system is shown for operation of a type 1 system at one saddle position with an on-off position control loop, to control the positions of the drives to produce variable profile forms of the roll gap.

Crown adjustment rack 1 is pinned via clevis pin 2 to threaded adjustment rod 3, which engages with screw threads in the bore of wormheel 4 driven by hydraulic motor 6 via spindle 7 and worm 5. Elements 3, 4, and 5 constitute the moving portions of the on/off position control loop system hydraulic jack. Hydraulic oil is supplied to hydraulic motor 6 via solenoid valve 8 and flow control valve module 9, the oil coming from a pressure source P and returning to tank Two solenoids 10 and 12 of solenoid valve 8 are energized as required by electronic computer 17 via a signal from digital output board 14 (such as the P10–12 board made by Metrabyte Corporation of Taunton, Mass.) to solid state relays 11 and 13 respectively.

An extension rod 20 attached to adjustment rod 3 is attached to the core of linear variable differential transformer (LVDT) 15, such as those made by Schaevitz Corporation of Pennsauken, N.J. LVDT 15 acts as a transducer to sense axial movement of extension rod 20 and the corresponding axial movement of rod 3, and sends an analog signal proportional to displacement of rod 3 to computer 17 via analog digital converter board 16 (such as the DAS-16 board made by Metrabyte Corporation). Other transducer types such as potentiometers or "Temposonics" transducers made by MTS Corporation of Eden Prairie, Minn. could also be used.

It should be understood that, since there are typically several saddle locations, it is not necessary to duplicate the entire arrangement at every saddle location. Only one computer 17, keyboard 18 and display 19 are required. Also, one digital output board 14 typically suffices for up to 12 channels and one analog/digital converter board 16 can typically be used for up to eight channels. This is usually sufficient for even the widest mills. Elements 1 through 13, 15 and 20 must be duplicated at each saddle location. It should also be noted that boards 14 and 16 can normally be plugged directly into the expansion slots of computer 17 and hence effectively become part of the computer. In the examples of FIGS. 1 to 5, 5 saddle locations are indicated, it being understood that each saddle location of mills having more or less saddle locations may be similarly controlled.

Figure 2:
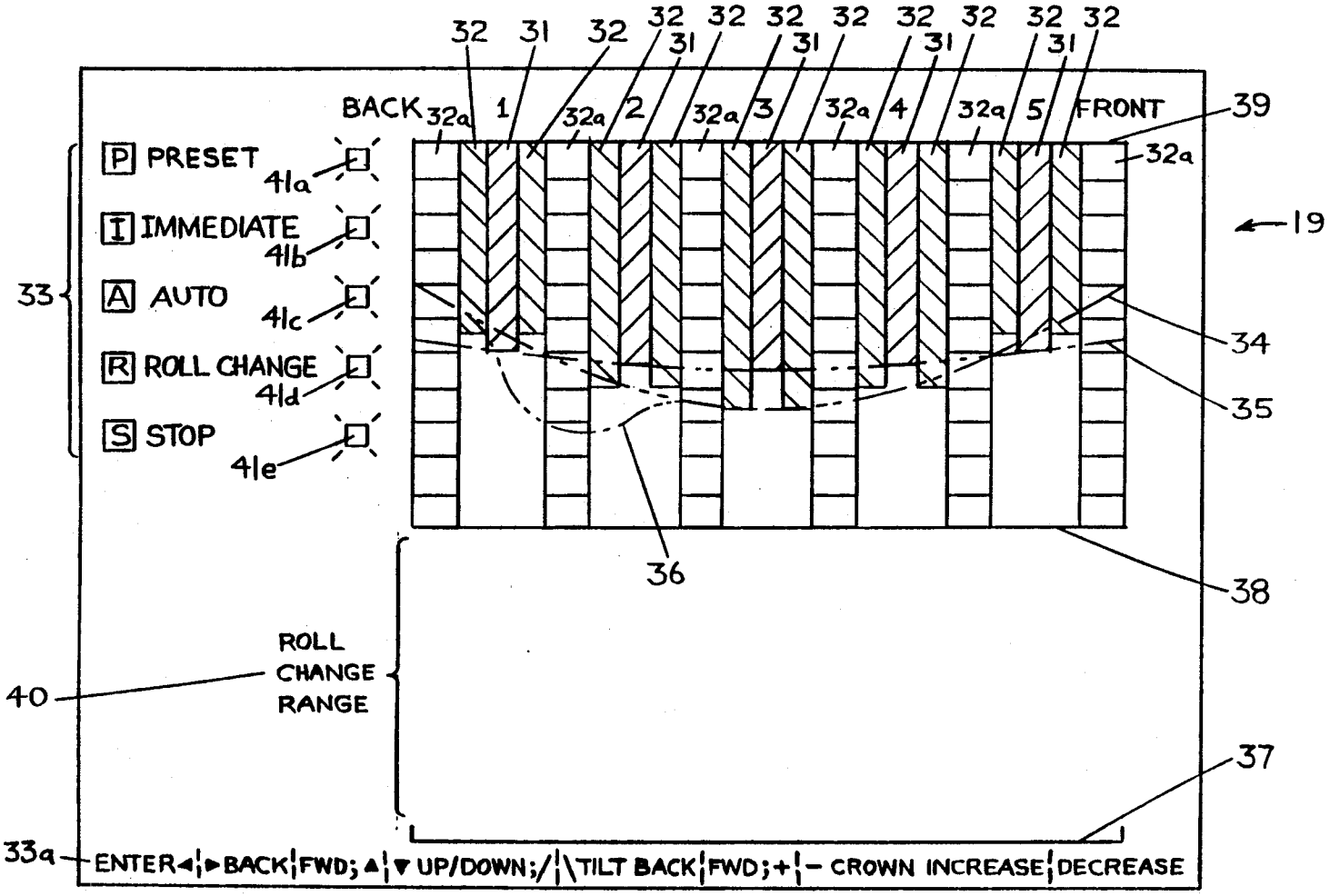
FIG. 2 is an enlarged diagrammatic view of the monitor display used with the mill computer control system.

In FIG. 2 there is shown an enlarged diagrammatic view of the screen of computer display 19. Display 19, which is preferably in color, is illustrated as monochromatic due to the black and white limitations of the drawings. Display 19 is illustrated for a mill having 4 bearings and 5 saddles on each backing shaft. Each saddle location is represented as a respective group of graph bars 31 and 32, separated from each other by scales 32*a*. Identified at saddle location 1 of display 19, which is typical of each saddle location representation, is central bar 31 and two side bars 32 on either side of central bar 31. Central bar 31 is a graphic representation of the preset rack position, as determined and established by computer 17 in response to keyboard commands by the operator, as described below. Side bars 32 are a graphic representation of the actual rack position as measured by LVDT 15. The lengths of both side bars 32 vary concomitantly with each other. It is noted that display 19 may use other methods, preferably graphic, to display the preset rack positions and actual rack positions, as well as any other relevant information.

The lower ends of central bar 31 and side bars 32 represent the preset rack positions and actual rack positions, respectively. The scale is inverted relative to the actual rack position because the scale is intended to represent the upper work roll position to the operator. Because of the geometry of the eccentric ring, the upper work roll actually moves up as the rack moves down. Thus, the top of the scale 39 represents the fully down rack position, while the bottom of the scale 37 represent the fully up rack position. The ends of bars 31 form the preset crown shape, as indicated by line 35. The ends of bars 32 represent the actual crown shape, as indicated by line 34.

When the racks are fully up, they are completely disengaged from the crown adjusting pinions. This is the "roll change" position, wherein the backing assemblies, which consist of the backing shaft, bearings, saddles, screw down gears and crown adjusting pinions, can be removed from the mill. The area between the top of the scale 39 and line 38 corresponds to the working range of the rack and roll movements. Line 38 represents the extreme upward position of the rack, corresponding to the extreme lower position of the roll in the working range.

It is noted that during normal operation of the mill, line 37 and "roll change" range indicator 40 are not normally displayed on the monitor. In accordance with the operational modes described below, computer 17 is programmed to prevent the movement of any rack and the setting of any preset rack position outside of the working range. Correspondingly, the lower ends of central bar 31 or side bars 32 can only be positioned between the top of the scale 39 and line 38, i.e. within the working range, during normal operation.

Display 19 also includes mode indicating indicia 33, specifically illustrated as "preset", "immediate", "auto", "roll change", and "stop". Each of the indicia represents an operational mode of the computer control system. An indicator is displayed or illuminated next to the appropriate mode indicator indicia 33, and is used to indicate the current operational mode of the system, respectively identified as 41*a*, 41*b*, 41*c*, 41*d* and 41*e*. Legend 33*a* is shown at the bottom of display 19, and indicates the commands corresponding to the keys on keyboard 18 which may be used to adjust the racks.

The position of each particular rack is controlled by a position control loop. One type is an on/off position control loop, such as is utilized with the embodiments shown in FIGS. 1 and 3. Another type is a proportional position control loop, as is utilized with the embodiments shown in FIGS. 4 and 5. The operation of the mill computer control system varies between the on/off position control loop and the proportional position control loop. For clarity, the mill computer control system will first be described in combination with an on/off position control loop, as is used with the embodiments shown in FIGS. 1 and 3. Following that complete description, the proportional position control loop as is used with the embodiments shown in FIGS. 4 and 5 will be detailed.

Figure 3:
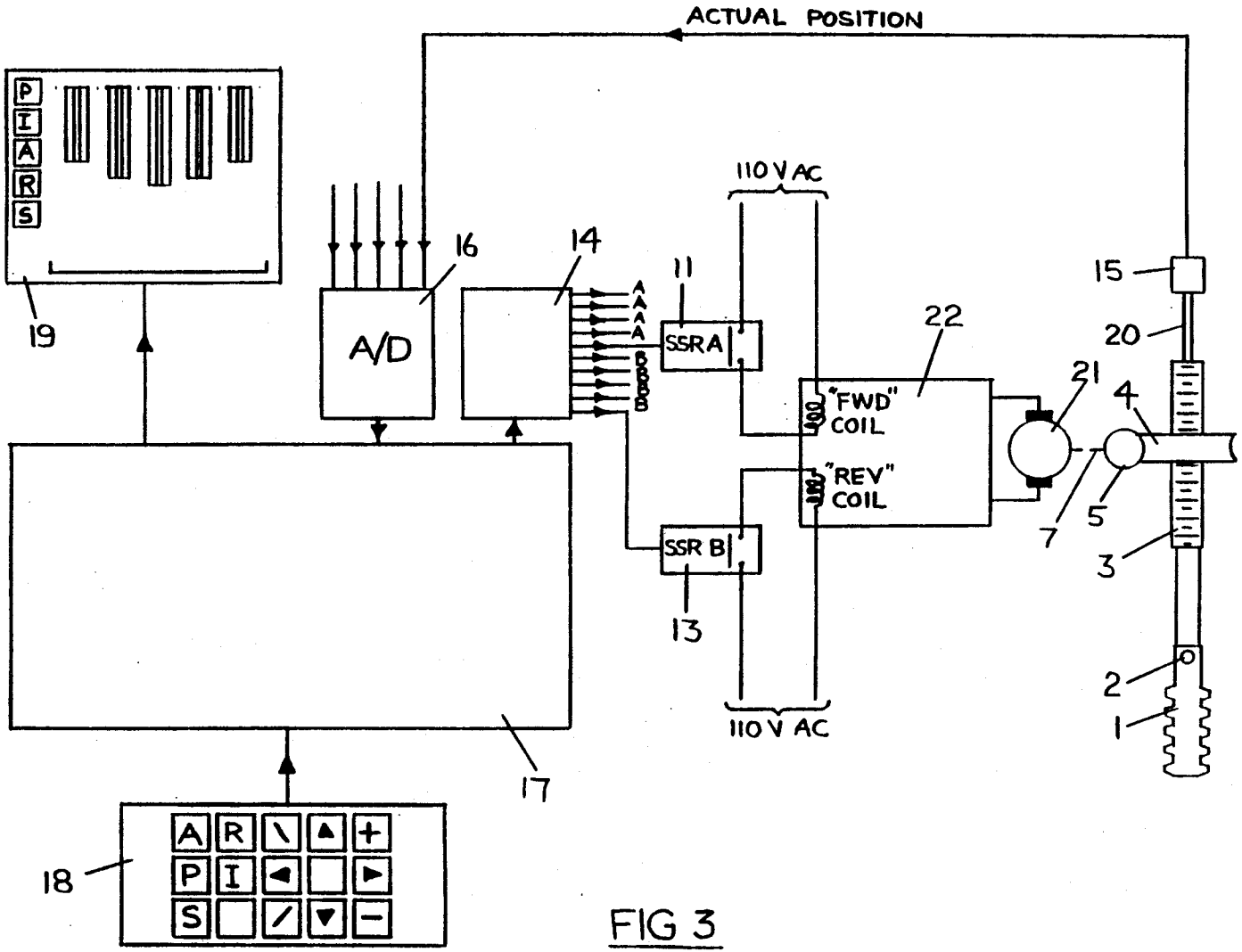
FIG. 3 is a schematic diagram showing a mill computer control system for operating and controlling a type 2 drive at one saddle location with an on-off position control loop.

As shown in FIGS. 1 and 3, the on/off position control loop function is performed by the computer. Based on selections made by the operator, the mill computer control system generates a "command" rack position for each rack. When a change in the actual rack position is desired a new "preset" rack position is selected by the operator, as described below. After a new preset rack position is selected, the command rack position is changed by the computer 17 and the position control loop function of the computer system is activated to effect the change in actual rack position, beginning by comparing the actual position of each rack, based on the signal from the position indicating LVDT 15, to the respective command rack position. The position control loop energizes the appropriate position control mechanism, such as solid state relay 11 or 13 (FIG. 1) to move the position of rack 1 until its actual position corresponds to the command rack position. An allowable tolerance range, referred to as hysteresis, is incorporated in the position control loop so that once the actual rack position is within the allowable range of the command rack position, the position control mechanism is turned off.

With the on/off closed position control loop control, the position control mechanism is activated by entering the appropriate operational mode (as described below) and remains activated until the actual rack position is within the hysteresis range of the command rack position. The screw jacks of FIGS. 1 and 3 do not allow drift, so active position control is not necessary. Once the command rack position has been achieved by the rack, the position control loop becomes inactive until a further change in the actual rack position is to be effected.

When the position control loop is active, rather than constantly monitoring the actual rack position of each rack, the position control loop continuously sequentially monitors the actual rack position of each rack in comparison to the corresponding command rack position for that rack. Once an actual rack position has been sampled, and the position control mechanism energized if necessary, the position control loop then monitors the actual rack position at the next saddle location, performing the same analysis and continuing on to each subsequent saddle location until the actual rack positions at all saddle locations have been sampled and analyzed in this manner. This cycle may be completely performed several times a second. If, upon the subsequent sampling of a particular saddle location where a rack is being moved, the actual rack position is within the allowable range of the command rack position, the position control loop deenergizes that rack's position control mechanism, and continues on thereafter to the next sequential saddle location. Thus, while active, the position control loop is continually monitoring the actual rack positions at all saddle locations by endlessly and sequentially cycling through all saddle locations as described. Once all of the racks have reached the new command rack positions, the position control loop becomes inactive.

As described above, when a new position is desired for any or all of the racks, a new preset rack position is selected by the operator, and new command rack positions will be set by the mill control system when one of the appropriate operational modes is entered, as described below. Once a new command rack position is set for any or all of the racks, and the appropriate operational mode is entered, the position control loop operates to drive the actual position of the racks to the position corresponding to the new command rack position. During this time, the movement of any individual rack is subject to a permissive condition which is set up to prevent excessive bending of the backing shafts of the mill and possible overloading of some saddles or bearings. During adjustment of the actual rack position, the shaft curvature is calculated based on the actual rack position of the rack being monitored, and of the actual rack positions at the neighboring saddle locations. (Neighboring saddle locations are not limited to the immediate neighbors.) If excessive curvature is present, the movement of that rack will be stopped, and reevaluated during the next monitoring cycle of the control loop. Once the curvature of the roll at that particular saddle location returns to within the permissive curvature, movement will be restarted.

The mill computer control system includes five operational modes, identified as preset, immediate, auto, roll change and stop Any particular operational mode is entered by executing the appropriate key stroke commands on keyboard 18, such as depressing the key corresponding to the first letter of the operational mode, as illustrated in the Figures.

The preset mode allows adjustments to the preset rack positions to be made without immediately effecting a change in the command rack position or the actual rack position. While the system is in the preset mode, the position control loop is inactive, precluding any movement of the racks.

In the preset mode, it is possible to adjust the preset rack position at a single saddle. Upon entering the preset mode, computer 17 selects a "current saddle", at which the preset rack position can be adjusted up or down by depressing the up arrow or down arrow on keyboard 18. The preset rack positions at other saddle locations may also be individually adjusted up or down by depressing the left or right arrow key until the desired saddle location becomes the "current" saddle location. The speed of change of the preset rack positions is controlled by the computer based on the program instructions.

Display 19 highlights the "current" saddle location which has been selected by the operator using the left arrow key or right arrow key, displaying central bar 31 of the "current" saddle in a different color, or in the case of a monochrome display, in different intensity or cross-hatching from that of the other saddles. The position of the lower end of central bar 31 moves concomitantly with the changes selected by depressing either the up arrow or down arrow key, to reflect the new preset rack position being set by the operator. As will be understood, as different saddle locations are selected as the "current" saddle, the corresponding central bar 31 is appropriately highlighted to identify the "current" saddle.

All of the preset rack positions may also be simultaneously moved up or down an equal amount, for example, by depressing the "U" key or the "D" key respectively.

In the preset mode, it is also possible to adjust the preset crown shape by changing all of the preset rack positions simultaneously by making the appropriate keyboard entry on keyboard 18, or any other appropriate means for inputting instructions to the computer 17. This can be accomplished, for example, by depressing the "+" key to make the preset crown shape more convex, and by depressing the "−" key to make the preset crown shape less convex. The ends of the respective central bars 31 move accordingly in response to the "+" or the "−" keys to reflect graphically on display 19 the changes to the preset rack positions which are being made. The more convex form of the crown shape is illustrated by line 34 in FIG. 2, while the less convex form is illustrated by line 35.

When the crown shape of the preset command rack positions is adjusted, the preset rack positions of the two outermost saddle locations are normally moved equally in the opposite direction in reference to the movement of the center saddle preset rack position. This enables full convex or concave profiles to be obtained, since at maximum convex crown, the preset rack position at the innermost saddle location will then be at one end of the working range and the preset rack position at the two outermost saddle locations will be at the other end of the working range.

It is also possible to tilt or taper in either direction and in various magnitudes the crown shape of the preset rack positions while in the preset mode (although this feature is used primarily in the immediate mode as described below) by making the appropriate entry through keyboard 18. For example, the "/" may be depressed to tilt the mill down at the back (the left side of display 19) or the " " to tilt the mill down at the front (the right side of display 19).

The system maintains or preserves the individual saddle location adjustments to the corresponding command rack positions even though the crown form of the roll gap or the tilt of the crown form is modified The vertical positions of the preset rack positions are determined according to at least one following predetermined equation which is stored in the memory of the computer 17. In the preferred embodiment, the predetermined equation is:

$$Y_s = K_1((X_s - C_1)^2 - C_2 + K_2(X_s - C_3) + K_h + K_s \quad (1)$$

Where $Y_s$ is the variable vertical rack position, $X_s$ is the fixed horizontal position of the saddle location relative to the mill center line $K_1$ is the crown shape coefficient, $K_2$ is the tilt coefficient, $K_h$ is the uniform height adjustment, $K_s$ is the individual saddle location adjustment, $C_1$ determines the horizontal location of the apex of the crown, $C_2$ determines the two fixed horizontal locations of the crown shape at which $Y_s$ does not change when the crown shape is adjusted, and $C_3$ determines the horizontal location of the center of the tilt form.

In the preferred embodiment of the invention as described herein, the apex of the crown form and the center of the tilt form are positioned at the physical center of the mill, by setting $C_1=0$ and $C_3=0$. Thus, formula (1) reduces to:

$$Y_s = K_1(X_s^2 - C_2) + K_2X_s + K_h + K_s \quad (2)$$

As mentioned above, adjustments to the crown shape produce preset rack position movements at the outer saddle locations which are in an opposite direction from the movement of the preset rack position of the center saddle position (the apex of the crown in the preferred embodiment). This necessarily means that the vertical location of the crown curve at two horizontal positions do not vary with changes in the crown curve. This enables the full concave or convex profiles to remain within the working range. The horizontal location of these two positions are determined by the value of $C_2$. In the preferred embodiment of the invention as described herein, $C_2$ is given by the formula:

$$C_2 = \frac{L^2}{2} \tag{3}$$

where L is the fixed horizontal distance from either outermost saddle location to mill center line.

This locates the two zero parabolic movement nodes at $$X = \pm \frac{L}{\sqrt{2}} \tag{4}$$

This location is unaffected by changes in $K_1$. Thus in the preferred embodiment, formula (2) becomes:

$$Y_s = K_1\left(X_s^2 - \frac{L^2}{2}\right) + K_2X_s + K_h + K_s \tag{5}$$

When the curvature of the crown form is being changed, the value of the crown shape coefficient $K_1$ is changed in response to depressing the "+" key or the "−" key. Similarly, when the magnitude and/or direction of tilt form is being effected by depressing the "/" "key" or the " ", "key" the computer changes the value of $K_2$. When the preset rack positions of the saddle locations are being individually adjusted, the value of $K_s$ for the respective saddle location is changed by the computer in response to depressing the up arrow or the down arrow key of keyboard 18. All preset rack positions may be moved up or down uniformly by increasing or decreasing the value of $K_h$ in response to keyboard commands, such as "U" or "D". Thus, as can be seen, individual saddle adjustment is not lost by changes to the crown shape or the tilt.

The computer program sets the rate at which the coefficients $K_1$, $K_2$, $K_h$ and $K_s$ are changed. Once the command rack positions and the actual rack positions become equal to the preset rack positions, they are also given by the above formulas.

It should be noted that although in the preferred embodiment formula (1) is a parabolic formula, any algebraic equation (including, for example, polynomial, exponential and linear equations) may be used. Additionally, the system may be set up to accommodate shifts in the horizontal location of the apex of the crown as well as the horizontal location of the center of the tilt function. It will be understood that formula (1) is the preferred embodiment of the predetermined equation, and other algebraic equations may be used without departing from this invention.

In the preset mode, adjustments to the preset rack positions are limited at all times by two premissive conditions. The first permissive condition is that the preset rack position as indicated by the bottom of central bar 31 must not be moved outside of the working range. In other words, the bottom of any bar 31 must not go above line 39 or below line 38. The second permissive condition is the excessive bending permissive condition described above with respect to the position control loop. An excessive bend is diagrammatically shown at 36 in FIG. 2. When applied in the preset mode, the excessive bending permissive condition prevents the preset rack position, and the corresponding bottom of any central bar 31 from being moved to a location which would cause excessive bending of the backing shafts of the mill once the position control loop is activated, as described below.

While in the preset mode, the command rack position has not been changed, and the position control loop has been inactive. Thus, after the preset rack positions have been changed at one or more saddles in the preset mode, the next step is to effect these changes in the mill by changing the command rack positions and activating the position control loop. This is accomplished by placing the mill computer control system in the auto mode by depressing the appropriate button on keyboard 18.

When the auto mode is entered from the preset mode, the preset mode indicator 41*a* is deleted and the auto mode indicator 41*c* is displayed. The command rack positions are set equal to the preset rack positions and the position control loop is activated, which then detects any difference between the newly set command rack position and the actual rack position, and operates as described above by energizing the appropriate position control mechanism in order to drive the actual rack position toward the command rack position, as appropriate, at each saddle location.

After a few seconds, the movements at all saddle locations will be complete. The mill computer control system will automatically switch to the stop mode, and indicate this by deleting the auto mode indicator 41*c* and displaying the stop mode indicator 41*e*. At this point, the position control loop is inactive and the actual rack position indicator bars 32 will be substantially equal in length to the corresponding central preset rack position bars 31.

The stop mode may also be entered directly from any other operational mode by the operator by depressing the appropriate key, such as "S". The stop mode deactivates the position control loop. Thus, if the stop mode is entered prior to the completion of all of the rack movements to the new command rack positions, at least one rack will be stopped short of its ultimate destination, and the length of the respective indicator bar 32 will be different from bar 31. If the auto mode (or immediate mode) is subsequently entered when such a difference between the actual rack position and the command rack position exists, the position control loop will be reactivated, and the rack will again be driven toward the command rack position, stopping when such command rack positions are achieved or when the stop mode is again entered.

The mill computer control system may also be operated in the immediate mode, which may be entered by depressing the appropriate key on keyboard 18. This causes any mode indicator being displayed to be deleted and immediate mode indicator 41*b* to be displayed.

In the immediate mode, the preset rack positions may be adjusted exactly as described above with reference to the preset mode. However, while in the immediate mode, the command rack positions are immediately set equal to the preset rack positions, and the position control loop is active and immediately senses any changes made in the command rack positions. The position control loop immediately begins to drive the corresponding racks in the appropriate directions upon any change to the preset rack positions. Thus, for example, if the operator depresses the down arrow key for the "current saddle location, the corresponding preset rack position bar 31 will progressively increase in length, and the actual rack position bars 32 will tend to follow bar 31. If the down arrow is held down continuously, the rate of change (as predetermined by the computer program with respect to the coefficients as described above) of the preset rack position (and, concomitantly, the command rack position) will be at least slightly greater than the rate of change of the actual rack position so as to preclude undesirable cyclical operation of relays 10 and 12 (or solid state relays 11 and 13). After releasing the down arrow key, the length of central preset rack position bar 31 will no longer change, and bars 32 will "catch up" to bar 31 and both will remain at the newly selected position.

Usually during the rolling operation, the immediate mode will be selected. In this way, the crown of the roll can be increased or decreased by hitting the "+" or "−" keys, and the tilt of the roll can be trimmed using the " " or "/" keys while a strip is being rolled. The mill computer control system thus allows contemporaneous adjustment of the relative tightness of the front and the rear edges of the strip being rolled, and ensures that the strip tracks straight down the middle of the mill. The ability to control the crown of the roll using two pushbuttons is of vast benefit to mill operators, and obviates the need for using 10 pushbuttons (for a mill having 5 saddles/shaft) or 5 separate sidewire controls. Of course, individual drives can still be adjusted in the immediate mode by using the four arrow keys on keyboard 18.

It should be noted here that adjustment of individual drives is important in that in some cases, due to tolerance accumulations, or imperfect component selection methods, the heights of the various saddle locations in a set of backing shaft assemblies for a mill are not perfectly matched. The result of this is that, even if the crown shape as set by the mill computer control system is flat or smoothly curved, there may be a localized chop or waviness in the strip at a localized location. This localized problem can be cured by adjusting the actual rack position at the corresponding saddle location or locations. When viewed on display 19 there would be an apparent discontinuity to the crown profile, although good rolling would result.

The last mode of operation is the roll change mode. This mode is utilized when there is no strip in the mill, and all rolls have been removed from the mill. It is intended to aid the maintenance department during the changing of the two backing shaft assemblies containing the crown adjusting pinions upon which the crown adjusting racks act. Before removing these assemblies from the mill it is necessary to withdraw the racks from engagement with the pinions, otherwise parts will become damaged.

The roll change mode is selected by hitting the key R on keyboard 18. This will cause roll change indicator **41*d* to be displayed, and any other indicator to be deleted. Also line 37 and roll change range sign 40** will appear on the display.

If the R key is held down, all the drives will operate together in the immediate mode, moving in the up direction with the command rack position being set equal to the preset rack positions. Preset rack position bars 31 and actual rack position bars 32, for all saddle positions 1 through 5, lengthen until the bottom end of all bars reach line 38, the end of the working zone. The rate of movement of all drives is such that the initial crown shape, such as that denoted by line 34, is progressively reduced, i.e., $K_1$ becomes zero as the bars increase in length until their bottom ends reach line 38 ($K_2$ is also zero at this point). From then on if the R key is held down, all the drives move together to raise the crown adjustment racks fully, and bring them all out of engagement with the crown adjustment pinions. The actual movement continues, and all bars 31 and 32 concomitantly increase in length until their bottoms reach line 37. At this point the racks are fully up and computer 17 stops the drives.

After roll change is completed, and the two backing shafts are replaced in the mill, the crown adjusting racks must be operated individually to engage them with the crown pinions on the backing shafts. This is done very carefully with a mechanic lying in the mill with a flashlight to check that the engagement takes place properly. The operator uses the left and right direction keys on keyboard 18 to select the saddle. First the crown adjustment rack at the back of the mill is selected. Then the operator uses the up direction key to drive the rack down into engagement (with bars 31 and 32 moving concomitantly upwardly) with the crown pinions, stopping and starting as instructed by the mechanic, until the rack is correctly engaged with the pinions, the bottom of bars 31 and 32 will then be above line 38.

This procedure is followed for all 5 saddle positions. Note that the shaft curvature limit permissive condition is disabled when the roll change mode has been selected, since the backing shafts cannot be caused to bend when the rack and pinions are out of engagement.

When the bottom ends of all 5 sets of bars 31 and 32 are above line 38, i.e. all 5 crown adjustment racks are fully engaged, the "I" or "P" key of keyboard 18 may be depressed by the operator. This changes the mode to immediate or preset, disables roll change mode, deletes line 37 and label 40 from the display, deletes roll change indicator **41*d*, and displays the appropriate mode indicator 41*a* or 41*b***.

At start-up of the mill, the computer control system deenergizes relays 11 and 13 for all 5 saddle positions. Computer 17 examines the 5 transducer output signals to determine the 5 actual rack positions, and displays these 5 positions on display 19 using the respective outer bars 32. Computer 17 sets the preset rack positions for the 5 saddle locations equal to the respective 5 actual rack positions and displays these preset rack positions using inner bars 31. This process avoids transient conditions at start up.

FIG. 3 shows a mill control system for a type 2 crown positioning system, where an AC electric motor 21 is used in place of hydraulic motor 6 of FIG. 1. To drive motor 21, reversing contactor 22 is used, with "forward" and "reverse" coils of contactor 22 being actuated by solid state relays 11 and 13. The operation of the mill control system of FIG. 3 is identical to that described above for the mill control system of FIG. 1.

Figure 4:
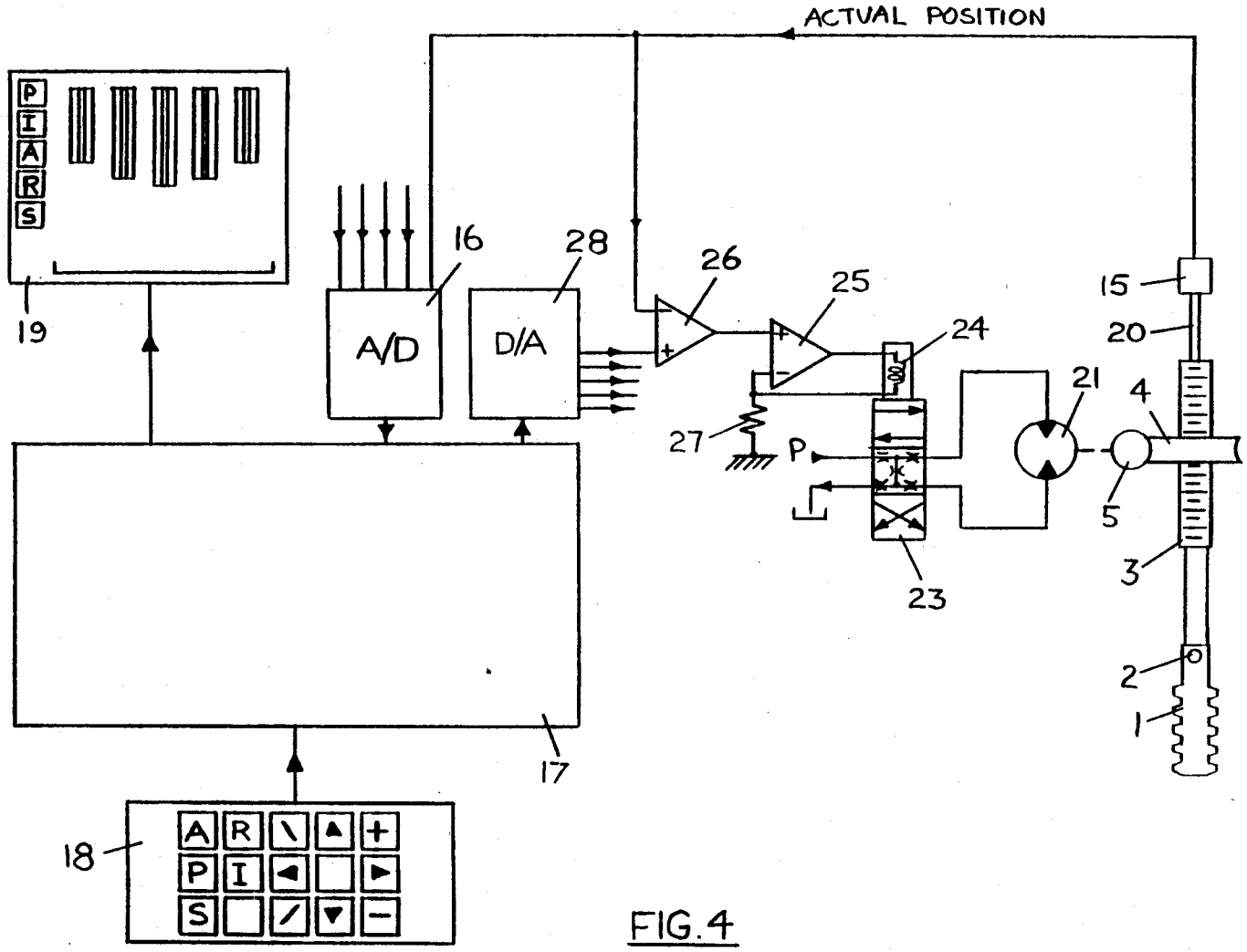
FIG. 4 is a schematic diagram showing a mill computer control system for operating and controlling a type 1 drive at one saddle location with a proportional position control loop.

FIG. 4 shows an embodiment of the present invention which is configured for a system having type 1 drives. The on-off position control loop of FIG. 1 is replaced by a proportional closed loop positioning system. The position of rack 1 and adjusting screw 3 is sensed by transducer 15 as described above in reference to FIG. 1. The command rack position set by computer 17 is converted to a suitably scaled analog command rack position signal by analog/digital interface board 28 (such as the DT 2815 made by Data Translation Corporation of Marlboro, Mass.). The analog signal is fed to the positive input of differential amplifier 26 with the actual rack position analog signal from transducer 15 being fed to the negative input of differential amplifier 26. The signal generated at the output of differential amplifier 26 represents the error signal which is proportional to the difference between the command rack position and the actual rack position. The output signal of differential amplifier 26 is suitably amplified, fed to the input of servoamplifier 25, whose output drives coil 24 of servovalve 23 with a current which is proportional to the error signal, the current being sensed by resistor 27. Coil 24 is connected so that the current causes the servovalve to deliver proportional oil flow to hydraulic motor 21 in such a direction as to drive the actual rack position towards the command rack position. The rack is therefore driven at a speed which is proportional to the difference between the actual rack position and the command rack position.

Figure 5:
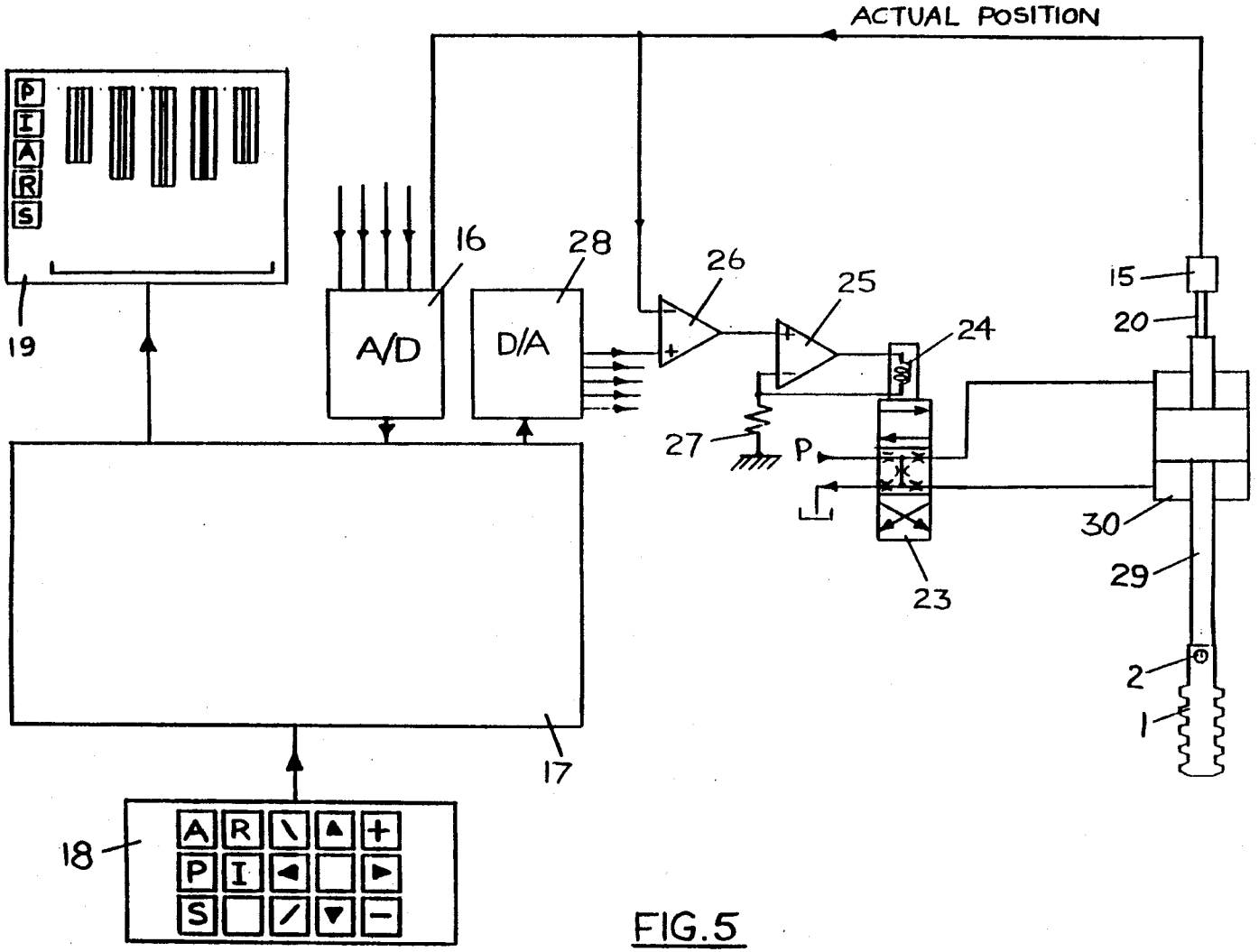
FIG. 5 is a schematic diagram showing a mill computer control system for operating and controlling a type 3 drive at one saddle location with a proportional position control loop.

Another embodiment is shown in FIG. 5 for a system having type 3 drives. The position control system is functionally identical to the embodiment of FIG. 4 although the hydraulic motor/worm/wormheel/ screw combination shown in FIG. 4 has been replaced by hydraulic cylinder 30, which is connected to rack 1 by piston rod 29 and clevis pin 2.

The embodiments of the present invention illustrated in FIGS. 4 and 5 utilize a proportional position control loop, which is accompanied by several functional differences in comparison to the on/off position control loop of the embodiment of FIGS. 1 and 3. In the embodiments of FIGS. 4 (for type 1 drives) and FIG. 5 (for type 3 drives), the position control loop function is performed by a separate D.C. analog type proportional control loop rather than by the computer 17. However, these embodiments are by way of example only, and it is entirely possible to remove the error amplifier 25 shown in these examples, and to use the computer 17 to subtract the actual rack position signal from the position signal, and to send the resultant position error signal, via the digital/analog output board directly to servoamplifier 25, without departing in any way from the spirit of the invention.

A further advantage of these embodiments of the present invention is that it is not necessary to adjust zero and span of position transducer 15. This is because the transducers can be effectively calibrated by storing their output signals at each end of the stroke in the computer's memory. Subsequently the computer calculates position sensed by the transducer by direct interpolation, comparing transducer output signal with the stored end of stroke signals.

The proportional position control loop is always active, holding the actual rack position at the command rack position with virtually no hysteresis. The proportional position control loop, continuously sequentially monitors the actual rack position of each rack in comparison to the corresponding command rack position for that rack, as with the on/off position control loop.

The computer 17 continuously generates a command rack position signal for each saddle location which is delivered to the proportional position control loop. The position control loop actively maintains the actual rack positions equal to the respective command rack positions, thereby compensating for any drift. In response to the setting of a new preset rack position and subsequent selection of the auto mode by the operator, the computer 17 does not change the position signal it sends to the control loop as a step function, i.e., all at once, but rather ramps (changes) the command rack position signal from its current value to a value corresponding to the preset rack position over a period of time. If the immediate mode is entered by the operator rather than the auto mode, the ramping of the command rack position signal is dictated by the predetermined rate of change of the coefficients (as described above), since the command rack positions are immediately set equal to the preset rack positions.

The rate of change (ramp rate) of the command rack position signal is selected so that the command rack position signal always remains at least slightly ahead of the changing actual rack position. In the present invention, the total full stroke time for the rack is 20 seconds. Thus, the ramp rate is slightly higher than that. By ramping the command rack position signal sent by the computer 17 to the control loop, not only do all racks move proportionally, but they all arrive at the respective final rack position at the same time regardless of any particular rack's starting position.

With the proportional control loop, the movement and position of each rack is simultaneously controlled by controlling the command rack position such that each rack reaches its final position at the same time regardless of where it started or how far it has traveled. This causes the racks to move simultaneously in unison in accordance with the predetermined equation, which, in the preferred embodiment, is formula (1). Thus, in the preferred embodiment, the racks move simultaneously in unison parabolically (when crown shape is preset) or linearly (when tilt is preset) rather than only to a parabolic location or a linear location. Of course, if the predetermined equation is not parabolic, but rather a different algebraic equation, then the movement will not necessarily be "parabolic", but the positional relationships between the drives will be maintained in accordance with the terms of the predetermined equation.

Figure 6:
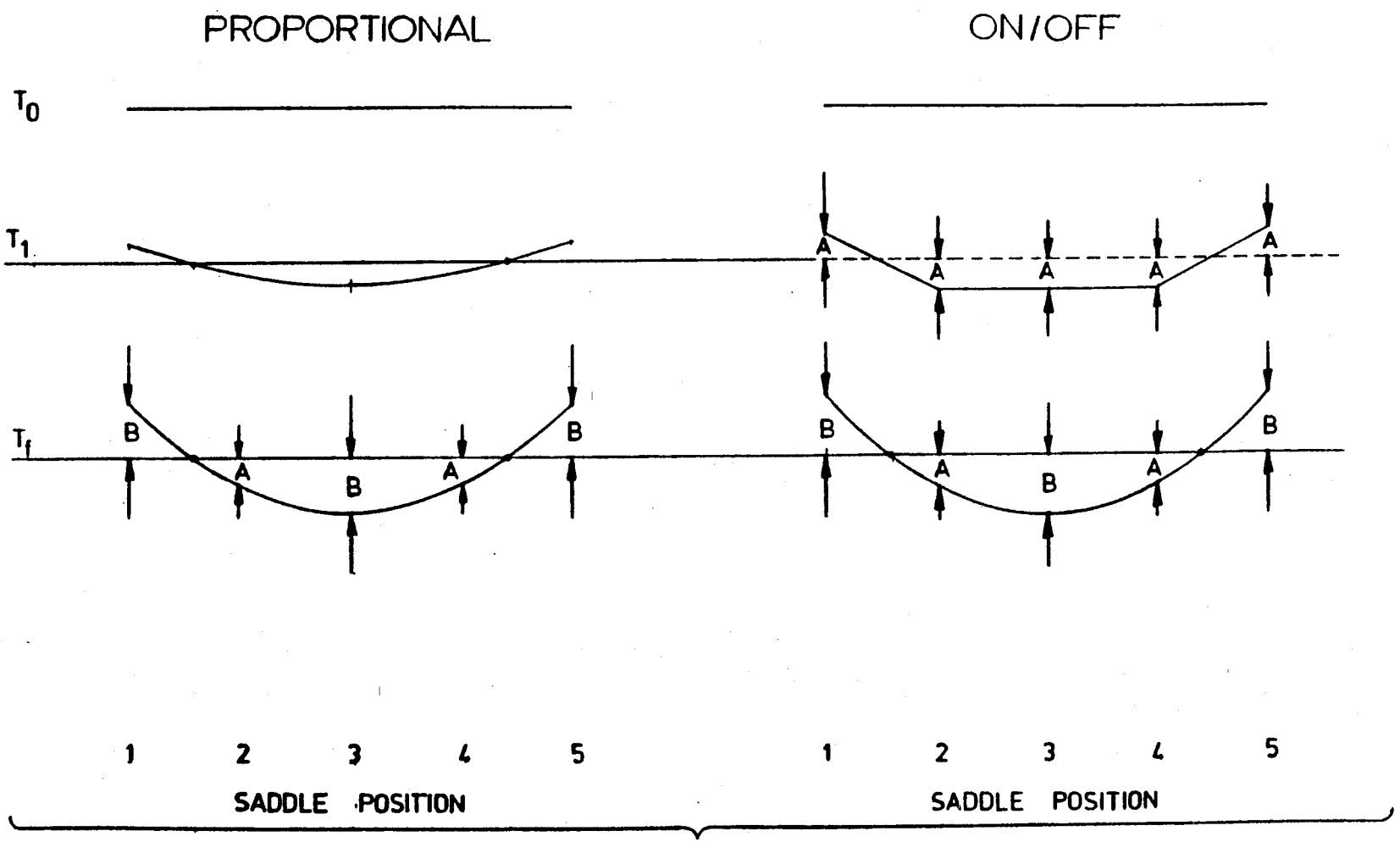
FIG. 6 is a graphical representation illustrating the intermediate crown shape of a mill as the profile is changed from a flat profile to a parabolic crown shape.
Figure 7:
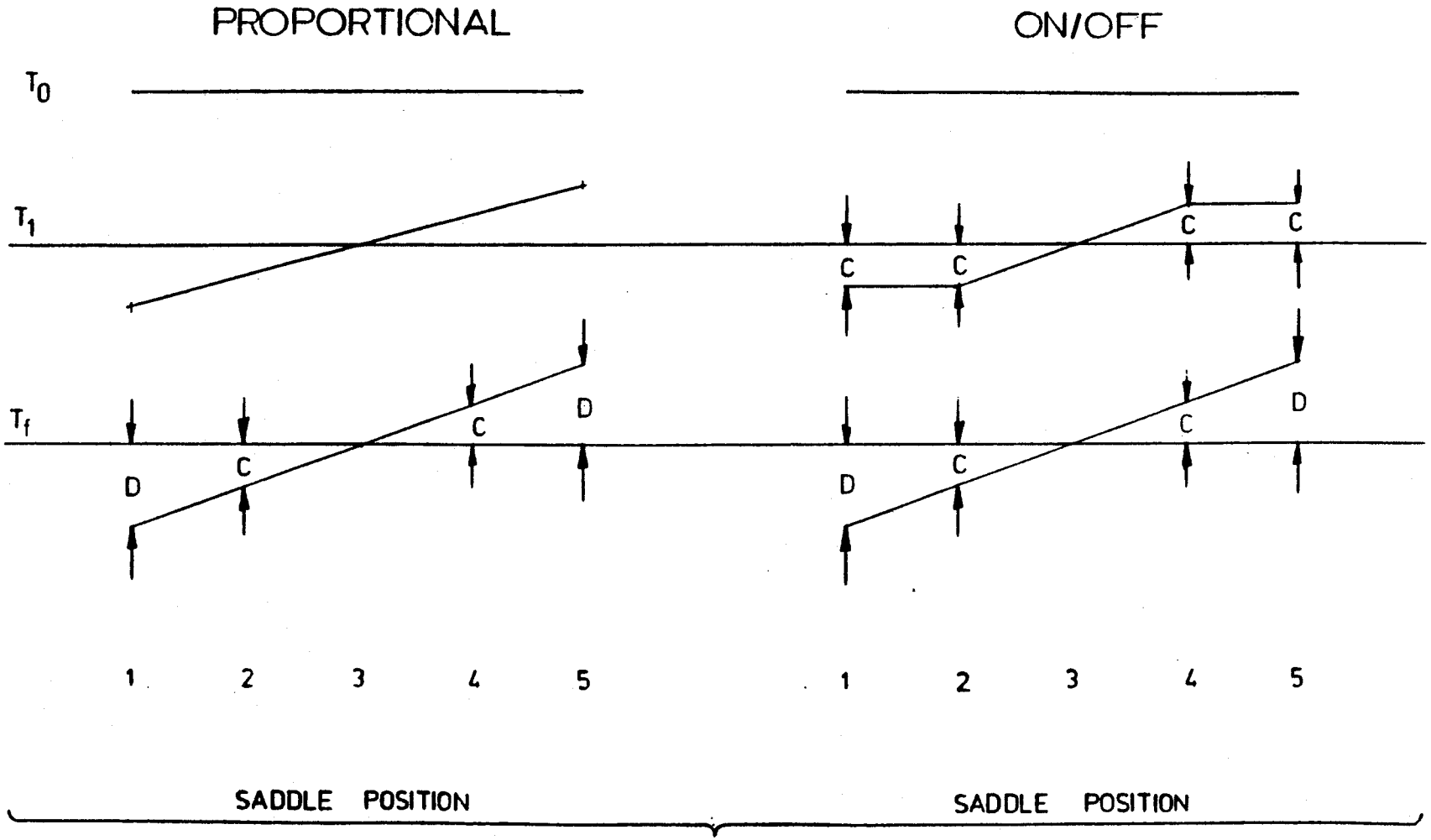
FIG. 7 is a graphical representation illustrating the intermediate crown shape of a mill as the profile is changed from a flat profile to a tilt profile.

FIGS. 6 and 7 illustrate the differences in the movement between the proportional position control loop and the on/off position control loop. FIG. 6 illustrates the intermediate crown shape of the mill as the profile is changed from a flat profile at $T_0$ to a parabolic crown shape profile according to formula (1) at $T_f$ for both the proportional and on/off control loops. In the left column of FIG. 6, the crown shape generated by the movement of the racks when controlled by the proportional control loop is illustrated as producing movement in accordance with formula (1) from start, $T_o$, to finish, $T_f$, and maintaining the position of the racks in accordance with formula (1) at any intermediate time, $T_1$. At $T_f$, the racks at the outermost saddles 1 and 5 have been moved a distance B above the reference line. The racks at saddles 2 and 4 have moved a distance A below the reference line, and the rack at saddle 3 has moved a distance B below the reference line.

Referring to the on/off control loop column of FIG. 6, there is illustrated the change in crown shape and accompanying movement of the racks which occurs with the on/off control loop. At $T_1$, the racks at saddles 2 and 4 have moved downwardly a distance equal to A, which is their respective final positions. Since all of the racks move at the same speed, the racks at outer saddle positions 1 and 5 have also traveled the same distance A above the reference line, and the rack at saddle 3 has moved the same distance A below the reference line. The crown shape shown at $T_f$ illustrates the final movement of the racks at saddles 1 and 5 to their final positions, a distance B above the reference line, and of the rack at saddle 3 a distance B below the reference line. The final crown shape for the on/off control loop is the same as the proportional control loop, although the on/off control loop did not generate simultaneous unison movement or intermediate positions in accordance with formula (1).

FIG. 7 illustrates the same principle as FIG. 6 when only tilt is present. With the proportional control loop, the tilt profile of the mill remains linear as it moves from its initial position to its final position. Starting with a flat profile at $T_0$, the tilt profile rotates about saddle position 3 essentially as a straight line to reach the final position at $T_f$, where the racks at saddles 1 and 5 have been displaced in opposite directions from the reference line a distance D, and the racks at saddles 2 and 4 have been displaced in opposite directions from the reference line a distance C. An intermediate, linear tilt profile is shown at $T_1$.

The on/off control loop column of FIG. 7 illustrates the corresponding movement of the racks and change of the tilt profile. At $T_1$, the racks at saddles 2 and 4 have traveled in opposite directions from the reference line a distance C, which is their respective final positions. Since all of the racks move at the same speed, the racks at outer saddle positions 1 and 5 have also traveled the same distance as the racks at saddle positions 2 and 4, resulting in the horizontal segments of the tilt profile between saddle positions 1 and 2 and saddle positions 4 and 5. Beyond $T_1$, only the racks at saddle positions 1 and 5 continue to move, until they have reached a distance D from the reference line as illustrated at $T_f$. The tilt profile of the on/off control loop at $T_f$ is identical to the tilt profile of the proportional control loop at $T_f$, although the movement between the initial position and the final position was not controlled according to formula (1).

One difference between the proportional control loop and the on/off control loop is thus seen to be that the drives are simultaneously controlled to move in unison (i.e. they maintain the positional relationships in accordance with the predetermined equation, which in the preferred embodiment is formula (1) during movement) when the proportional control loop is used. With the on/off control loop, the drives are not so controlled.

When the mill computer control system is in the preset mode, the command rack positions cannot be changed, but the preset rack positions may be changed as described above in reference to the on/off position control loop. However, although the position control loop is active, the actual rack position does not change, because the command rack position and corresponding command rack position signals generated by the computer 17 do not change in the preset mode, but remain at the previous command rack positions (which in equilibrium, are the actual rack positions).

When the auto mode is entered from the preset mode, the computer immediately begins to ramp the command rack position signals toward the new preset rack position, thereby causing the position control loop to begin driving the racks. Once the new preset rack positions have been achieved by all the racks, the system automatically enters the stop mode, wherein further changes in the command rack position signals do not occur even though the position control loop remains active. Indicator bars 31 and 32 for each respective saddle location will now be equal in length.

If the stop mode is entered manually from the automatic mode by the operator before the complete change of all the racks has occurred, movement of all of the racks is stopped. This is accomplished by preventing further ramping of the command rack position signals. This permits the position control loop to remain active, holding the actual rack positions equal to the respective command rack positions as they existed at the time that stop was entered. Reentering the auto mode at this point will restart the ramping process toward the preset rack position from where the process was stopped.

In the immediate mode, the command rack position signal will exactly track any changes in the respective preset rack position. If any movement key, such as the down arrow, is depressed continuously, changes in the command rack position will occur slightly faster than changes in the actual rack position. Movements of the racks are still subject to the permissive conditions outlined above. These conditions are controlled by the computer 17 by controlling the command rack position signals so that the conditions are met. If a saddle location does not meet the conditions, further movement at that location is prevented until such time as the conditions are met. Changes in the crown shape or tilt are prevented if such changes would attempt to set the rack position outside of the working range.

A number of additional features are enabled by using the mill computer control system. For example, if a particular crown profile is found to be effective when rolling a particular pass (defined by material to be rolled, its initial thickness, width and hardness, and its final thickness), such a profile can be stored in the computer's memory and recalled by the operator when needed. A number of such profiles can be stored. A stored crown profile consists (in the embodiments described) of a set of five stored rack position values, one for each of the five racks. When a stored crown profile is recalled, the respective preset rack position values are set equal to the five stored rack position values.

It is also possible to define a rack force profile as a set of five racks forces, one for each rack. The rack forces can be measured using pressure transducers (not shown) connected to each cylinder in the embodiment of FIG. 5. Thus, for example, if a particular rack force profile is found to be effective when rolling a particular pass, such a profile can be stored on the computer and recalled by the operator when needed.

In such a case the rack force profile could be displayed on a screen similar to that shown in FIG. 2 where the central bars 31 would represent the preset rack force and the outer bars 32 would represent the actual rack force. The rack force is actually a measure of roll separating force which should be substantially constant across the width of the strip. Thus for a strip which is narrow relative to the width of the mill, the rack force on each of the saddles which lie within the width of the strip should be substantially equal, whereas the rack force on those saddles which lie outside the width of the strip should be close to zero.

In this way, embodiments of the invention would work in substantially the same way as for the embodiment of FIG. 5 described above but using rack force control rather than rack position control.

It is also possible to operate based on rack position control only, as shown in FIGS. 1, and 3–5, but to provide the operator with a display of rack force at each saddle location in addition to the rack position display, enabling the operator to adjust the rack positions to give the desired rack force profile.

It should be understood that, in all embodiments, where single key press commands on computer keyboard 18 are used to activate the various functions, it is also possible to use 2 (or more) key combinations such as <CTRL> preceding other keys. This procedure has the advantage of minimizing the possibility of accidental key presses affecting the system. As used in this specification and claims, single key press commands includes such 2 (or more) key combinations.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended hereto.

We claim:

1. In a cluster mill of the type having spaced-apart, opposing upper and lower clusters, each of said clusters having work rills, intermediate rolls, and backing bearings, wherein positioning of said work rolls defines a roll gap therebetween, said upper and lower clusters having a plurality of individual drives, each of said drives being capable of causing positional movement independent of one another, each of said drives being used to position one of a plurality of racks, the movement of said racks tending to shape at least one of a plurality of backing shafts each of which is supported at a plurality of locations along its length by saddles, the movement of said racks also shaping the roll gap, a crown adjustment control system having computer-controlled means for causing and controlling simultaneous movement of at least two of said drives in unison in accordance with at least one predetermined equation defining the position of the racks so as to produce a profile form of the roll gap which can be varied by the movement of said plurality of racks, thus defining a plurality of variable profile forms, wherein said profile forms comprise a plurality of crown forms of varying curvatures, and comprising means for making adjustments to the positions of selected individual racks, said adjustments being preserved during any change to the profile form of the roll gap.

2. The cluster mill of claim 1 comprising means for tilting said crown forms of the roll gap.

3. The cluster mill of claim 1 wherein said profile forms comprise a plurality of tapered forms of varying magnitudes and of varying directions.

4. In a cluster mill of the type having spaced-apart, opposing upper and lower clusters, each of said clusters having work rills, intermediate rolls, and backing bearings, wherein positioning of said work rolls defines a roll gap therebetween, said upper and lower clusters having a plurality of individual drives, each of said drives being capable of causing positional movement independent of one another, each of said drives being used to position one of a plurality of racks, the movement of said racks tending to shape at least one of a plurality of backing shafts each of which is supported at a plurality of locations along its length by saddles, the movement of said racks also shaping the roll gap, a crown adjustment control system having computer-controlled means for causing and controlling simultaneous movement of at least two of said drives in unison in accordance with at least one predetermined equation defining the position of the racks so as to produce a profile form of the roll gap which can be varied by the movement of said plurality of racks, thus defining a plurality of variable profile forms, wherein said profile forms comprise a plurality of crown forms of varying curvatures, and wherein each rack has a vertical position which is variable, wherein said cluster mill has a center line, wherein each saddle is located at a horizontal position which is fixed relative to said mill center line, wherein one of said crown forms is partially defined by a crown coefficient which is used to determine the degree that said crown form is more convex or less convex, wherein said crown form can be tilted to one side in either direction resulting in a tilt form which is defined by a tilt coefficient, wherein each rack can be moved vertically as defined by a uniform height adjustment which affects all other racks of said cluster mill, wherein each rack can be individually moved vertically as defined by an individual saddle location adjustment, wherein each crown form has an apex which has a horizontal location along the crown form, wherein each crown form has two locations that are fixed in the horizontal direction along the crown form in which the vertical position of the crown does not change as the crown form is adjusted, wherein said tilt form has a center which has a horizontal location along the tilt form, and wherein said at least one predetermined equation for one of said racks and saddles comprises:

$$Ys = K1((Xs - C1)^2 - C2) + K2(Xs - C3) + Kh + Ks$$

Where

Ys is the variable vertical rack position,

Xs is the fixed horizontal position of the saddle location relative to the mill center line, K1 is the crown shape coefficient, K2 is the tilt coefficient, Kh is the uniform height adjustment, Ks is the individual saddle location adjustment, C1 determines the two fixed horizontal locations of the apex of the crown form, C2 determines the two fixed horizontal locations of the crown form at which Ys does not change when the crown forms is adjusted, and C3 determines the horizontal location of the center of the tilt form.

5. The cluster mill of claim 4 wherein $$C_2 = \frac{L^2}{2}$$

where L is the fixed horizontal distance from either outermost saddle location to mill center line.

* * * * *